US006447357B1

(12) United States Patent
Pearl

(10) Patent No.: US 6,447,357 B1
(45) Date of Patent: Sep. 10, 2002

(54) BUBBLE RING

(76) Inventor: Louis Pearl, P.O. Box 436, Sausalito, CA (US) 94966

( * ) Notice: Subject to any disclaimer, the term of this patent is extended or adjusted under 35 U.S.C. 154(b) by 0 days.

(21) Appl. No.: 10/068,499

(22) Filed: Feb. 5, 2002

(51) Int. Cl.[7] ..... A63H 27/27
(52) U.S. Cl. ..... 446/45
(58) Field of Search ..... 446/15, 16–21; D21/401, 402

(56) References Cited

U.S. PATENT DOCUMENTS

| | | | | |
|---|---|---|---|---|
| 2,514,009 A | * | 7/1950 | Raspet | |
| 3,064,387 A | | 11/1962 | Campbell | |
| D235,030 S | * | 4/1975 | Ziff | |
| 3,950,887 A | | 4/1976 | Kort | |
| 4,481,731 A | * | 11/1984 | La Fata et al. | 446/15 |
| 4,654,017 A | | 3/1987 | Stein | |
| 5,071,382 A | | 12/1991 | Sanford | |
| 5,080,623 A | * | 1/1992 | Stein | 446/15 |
| 5,156,564 A | | 10/1992 | Hasegawa | |
| 5,183,428 A | * | 2/1993 | Lin | 446/15 |
| D335,177 S | * | 4/1993 | Jones et al. | D24/128 |
| 6,102,764 A | | 8/2000 | Thai | |

FOREIGN PATENT DOCUMENTS

| | | |
|---|---|---|
| GB | 1509848 | 5/1978 |

* cited by examiner

*Primary Examiner*—Derris H. Banks
*Assistant Examiner*—Jamila Williams
(74) *Attorney, Agent, or Firm*—Jack Lo

(57) ABSTRACT

A bubble ring is comprised of a tubular wall with a height which is greater than its wall thickness. The wall is parallel to the axis of the ring for reducing resistance to airflow along the axis of the ring. Plates extend radially from the inside and outside surfaces of the ring for holding a bubble solution by surface tension and capillary action. The gaps between the plates are generally evenly wide throughout for evenly holding bubble solution. The gaps also have open front and rear ends aligned with the axis of the ring for better releasing solution. Through holes are arranged in the wall parallel to the axis of the ring for holding and releasing additional solution. A handle is hinged to the ring. The handle is pivoted across the ring for shipping, and pivoted outward for use.

12 Claims, 1 Drawing Sheet

BUBBLE RING

BACKGROUND OF THE INVENTION

1. Field of the Invention

This invention relates generally to bubble wands and rings.

2. Prior Art

A bubble wand is a loop or ring attached to a handle for making bubble when the ring is blown by the mouth or moved quickly through the air. Closely spaced ridges are arranged on the ring for trapping a soapy bubble solution by surface tension and capillary action. The amount of bubble that can be produced each time depends on the amount of bubble solution which can be held on the ring, and the amount of bubble solution which can be discharged from the ring. However, a typical ring is disc shaped with a wall that is perpendicular to the axis of the ring, so that it impedes airflow and limits solution discharge.

Many other bubble wands are known among the prior art. U.S. Pat. No. 3,064,387 to Campbell shows a coil spring positioned around a bubble ring. The spring is made of a wire which is very narrow relative to the diameter of the ring, and cannot hold much solution. U.S. Pat. No. 3,950,887 to Kort discloses a thin bubble ring with small arms projecting from the interior of the ring. Since the ring is comprised of a very narrow cylindrical rod formed into a loop, the arms are also very thin and thus cannot hold much solution. U.S. Pat. No. 4,654,017 to Stein discloses a long chain or cord with cups which are too far apart for capillary action to hold much solution between them. U.S. Pat. No. 5,071,382 to Sanford discloses a bubble ring with plates radiating from the outside of the ring. The plates are too far apart to hold solution with capillary action, and there are no plates on the inside of the ring. U.S. Pat. No. 5,156,564 to Hasegawa and U.K. patent 1,509,848 to Adachi each show corrugated bubble tubes. The adjacent pleats in the tubes define triangular spaces between them that cannot hold solution with capillary action at the outer ends where they are farthest apart. U.S. Pat. No. 6,102,764 to Thai discloses a bubble ring with ridges on the top and sides. The ridges are much thinner than the core of the ring, and are too far apart to hold much solution. Further, solution trapped between the ridges on top are perpendicular to the airflow and thus cannot be easily discharged. Prior art bubble wands also have fixed handles that require relatively large packaging.

BRIEF SUMMARY OF THE INVENTION

The objects of the present bubble ring are:

to hold more bubble solution;

to discharge the solution more effectively; and to have a handle which is compacted for shipping and extendable for use.

The present bubble ring is comprised of a tubular wall with a height which is greater than its wall thickness. The wall is parallel to the axis of the ring for reducing resistance to airflow along the axis of the ring. Plates extend radially from the inside and outside surfaces of the ring for holding a bubble solution by surface tension and capillary action. The gaps between the plates are generally evenly wide throughout for evenly holding bubble solution. The gaps also have open front and rear ends aligned with the axis of the ring for better releasing solution. Through holes are arranged in the wall parallel to the axis of the ring for holding and releasing additional solution. A handle is hinged to the ring. The handle is pivoted across the ring for shipping, and pivoted outward for use.

DRAWING REFERENCE NUMERALS

10. Bubble Ring
11. Tubular Wall
12. Plates
13. Holes
14. Handle
15. Bracket
16. Gap Between Plates
17. Front End of Gap
18. Rear End of Gap

DETAILED DESCRIPTION OF THE INVENTION

Figure 1:
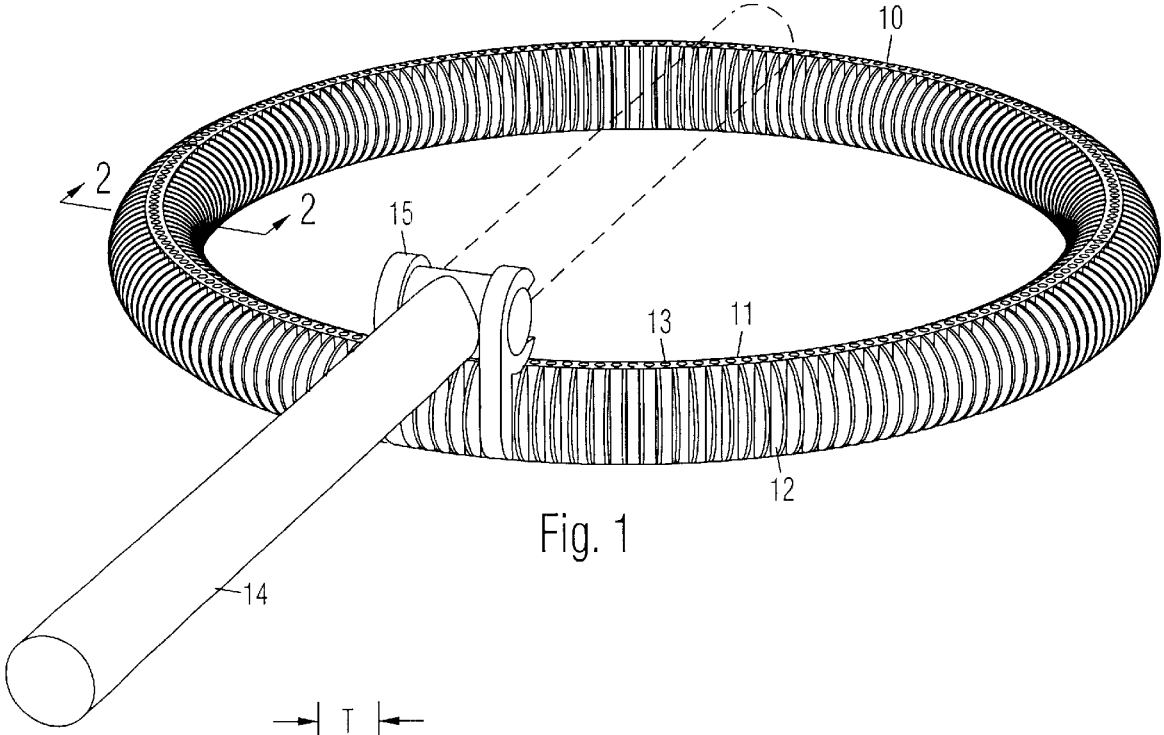
FIG. 1 is a side perspective view of the present bubble ring.

A preferred embodiment of a bubble ring 10 is shown in a side perspective view in FIG. 1. It is comprised of a tubular wall 11 with plates 12 extending radially from its inner and outer sides for holding a bubble solution by surface tension and capillary action. Through holes 13 are arranged in wall 11 parallel to the axis of ring 10 for holding additional solution. A handle 14 is hinged to ring 10, preferably between brackets 15 attached to wall 11. The dashed lines show handle 14 in a shipping position wherein it is folded across the diameter of ring 10 for more compact packaging. The solid lines show handle 14 pivoted outward and latched in an operating position extending away from ring 10. Alternatively, handle 14 may be fixedly attached.

Figure 2:
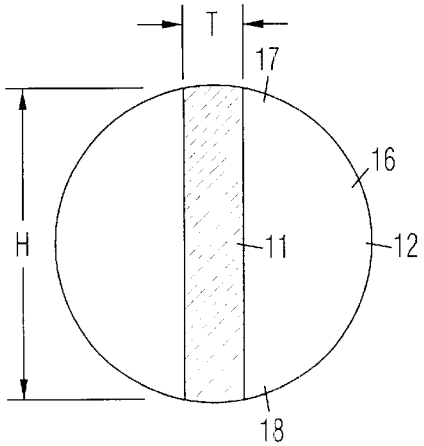
FIG. 2 is a sectional view thereof, taken along line 2—2 in FIG. 1.

As shown in the sectional view in FIG. 2, tubular wall 11 has a height which is substantially greater than its wall thickness. In this example, wall 11 has a height H of about 16 mm and a thickness T of about 3.3 mm. Therefore, wall 11 is elongated in a direction parallel to the axis of ring 10 of for reducing resistance to airflow along the axis of ring 10. Plates 12 are preferably semi-circular, so that the plates on opposite sides of wall 11 cooperate to define a generally cylindrical ring for comfortable handling.

Figure 3:
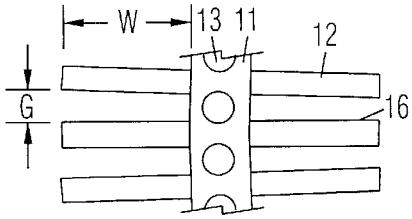
FIG. 3 is a top view thereof

As shown in the top view in FIG. 3, plates 12 extend radially from the inside surface as well as the outside surface of wall 11 for holding more soapy solution by surface tension and capillary action. Each plate 12 preferably has a width W which is at least about twice the thickness of wall 11. In this example, each plate 12 is at least about 6.4 mm wide. Each gap 16 between plates 12 preferably has a width G of about 0.8 to 1.5 mm, which is close enough for effectively trapping solution by capillary action, but still wide enough for enabling air to blow through. Adjacent plates 12 are generally parallel to each other, so that each gap 16 is evenly wide throughout for evening holding the bubble solution. Holes 13 are arranged in wall 11 parallel to the axis of ring 10, and extending between the ends of wall 11 for holding and releasing additional solution.

Referring to FIG. 2, each gap 16 between plates 12 has an open front end 17 and an open rear end 18 which are aligned with the axis of ring 10 for releasing more solution when air is blown along the axis of ring 10.

Accordingly, the present bubble ring is arranged to hold more bubble solution between its plates and within the holes. The plates and holes are aligned to discharge the solution more effectively. It also has a handle which is compacted for shipping and extendable for use.

Although the foregoing description is specific, it should not be considered as a limitation on the scope of the invention, but only as an example of the preferred embodiment. Many variations are possible within the teachings of the invention. For example, different attachment methods, fasteners, materials, dimensions, etc. can be used unless specifically indicated otherwise. The relative positions of the elements can vary, and the shapes of the elements can vary. Therefore, the scope of the invention should be determined by the appended claims and their legal equivalents, not by the examples given.

I claim:

1. A bubble ring, comprising:

a tubular wall with a central axis, and a height greater than a wall thickness thereof so that said tubular wall extends parallel to said axis for reducing resistance to airflow along said axis; and plates extending radially from inner and outer sides of said tubular wall;

wherein plates on each side of said tubular wall are separated by gaps for holding a bubble solution by surface tension and capillary action; and wherein each of said plates has a width which is at least about twice said thickness of said tubular wall for holding said bubble solution.

2. The bubble ring of claim 1, wherein said plates are semi-circular, so that said plates on opposite sides of said wall cooperate to define a generally cylindrical ring for comfortable handling.

3. The bubble ring of claim 1, wherein said tubular wall is about 3.3 mm thick, and each of said plates is about 6.4 mm wide.

4. The bubble ring of claim 1, wherein adjacent plates are generally parallel to each other, and each of said gaps is generally evenly thick throughout for evenly holding said bubble solution.

5. The bubble ring of claim 1, where each of said gaps is each about 0.8 to 1.5 mm wide, which is close enough for holding said bubble solution by capillary action, but still wide enough for enabling said airflow to pass through.

6. The bubble ring of claim 1, wherein each of said gaps has an open front end and an open rear end aligned with said axis for facilitating releasing said bubble solution to said airflow along said axis.

7. The bubble ring of claim 1, further including through holes arranged in said tubular wall parallel to said axis for holding additional bubble solution.

8. The bubble ring of claim 1, further including a handle hinged to said tubular wall and movable to a shipping position folded across a diameter of said tubular wall for more compact packaging, and foldable to an operating position extending away from said tubular wall.

9. A bubble ring, comprising:

a tubular wall with a central axis, and a height greater than a wall thickness thereof so that said tubular wall extends parallel to said axis for reducing resistance to airflow along said axis;

plates extending radially from inner and outer sides of said tubular wall;

wherein plates on each side of said tubular wall are separated by gaps for holding a bubble solution by surface tension and capillary action;

wherein each of said plates has a width which is at least about twice said thickness of said tubular wall for holding said bubble solution;

wherein adjacent plates are generally parallel to each other, so that each of said gaps is generally evenly thick throughout for evenly holding said bubble solution;

wherein each of said gaps has an open front end and an open rear end aligned with said axis for facilitating releasing said bubble solution to said airflow along said axis; and a handle hinged to said tubular wall and movable to a shipping position folded across a diameter of said tubular wall for more compact packaging, and foldable to an operating position extending away from said tubular wall.

10. The bubble ring of claim 9, wherein said plates are semi-circular, so that said plates on opposite sides of said wall cooperate to define a generally cylindrical ring for comfortable handling.

11. The bubble ring of claim 9, where each of said gaps is each about 0.8 to 1.5 mm wide, which is close enough for holding said bubble solution by capillary action, but still wide enough for enabling said airflow to pass through.

12. The bubble ring of claim 9, further including through holes arranged in said tubular wall parallel to said axis for holding additional bubble solution.

* * * * *